US007879443B2

(12) United States Patent
Endrino

(10) Patent No.: US 7,879,443 B2
(45) Date of Patent: Feb. 1, 2011

(54) HIGH WEAR RESISTANT TRIPLEX COATING FOR CUTTING TOOLS

(75) Inventor: Jose Endrino, Berkeley, CA (US)

(73) Assignee: OC Oerlikon Trading AG, Truebbach, Truebbach (CH)

( * ) Notice: Subject to any disclaimer, the term of this patent is extended or adjusted under 35 U.S.C. 154(b) by 681 days.

(21) Appl. No.: 11/815,978

(22) PCT Filed: Feb. 7, 2006

(86) PCT No.: PCT/CH2006/000076

§ 371 (c)(1),
(2), (4) Date: Sep. 25, 2007

(87) PCT Pub. No.: WO2006/084404

PCT Pub. Date: Aug. 17, 2006

(65) Prior Publication Data

US 2010/0129644 A1 May 27, 2010

Related U.S. Application Data

(60) Provisional application No. 60/651,916, filed on Feb. 10, 2005.

(51) Int. Cl.
*B32B 9/00* (2006.01)

(52) U.S. Cl. ..... 428/408; 51/307; 51/309; 428/336; 428/472; 428/697; 428/698; 428/699

(58) Field of Classification Search ..... 51/307, 51/309; 428/336, 408, 472, 697, 698, 699
See application file for complete search history.

(56) References Cited

U.S. PATENT DOCUMENTS 6,274,257 B1 * 8/2001 Aharonov et al. ..... 428/472
6,586,122 B2 * 7/2003 Ishikawa et al. ..... 51/307

(Continued)

FOREIGN PATENT DOCUMENTS

| | | | |
|---|---|---|---|
| EP | 1 174 528 A | | 1/2002 |
| JP | 06-322517 | * | 11/1994 |
| JP | 09-041127 | * | 2/1997 |

(Continued)

OTHER PUBLICATIONS

Veeter, j. et al: "(Cr:A1)N coatings deposited by the cathodic vacuum arc evaporation" Surface and Coatings Technology, Elsevier, Amsterdam, NL, vol. 98, No. 1-3, Jan. 1998, pp. 1233-1239, XP002347451. ISSN: 0257-8972. p. 1233, left-hand col., para 1—p. 1234, left-hand col. para. 2.1; p. 1235, right-hand col., para. 3.5—p. 1236, left-hand col. fig 5: table 1; p. 1239, right-hand col, para.4.

(Continued)

*Primary Examiner*—Archene Turner
(74) *Attorney, Agent, or Firm*—Pearne & Gordon LLP

(57) ABSTRACT

A hard coating layer system comprises at least a main layer (3) on a surface of a substrate (1), a buried layer (4) and an outer surface layer (5), wherein the surface layer (5) comprises AlCrZ, where Z stands for N, C, B, CN, BN, CBN, NO, CO, BO, CNO, BNO, or CBNO In such innovative coating triplex system and corresponding coated tools and components the buried comprises any one of the following materials or their combinations: a metal nitride, carbide or carbonitride a metal silicon nitride, carbide, or carbonitride, wherein the metal is at least one transition metal of the IVB, VB or VIB group or a multilayer of the materials or a material or a combination or a multilayer of the materials comprising at least one metal or carbon, preferably a diamond like carbon layer. The main layer comprises a nitride, carbide or carbonitride or a multilayer of nitride, carbide or carbonitride material. The main layer can be deposited on the workpiece either directly or via an interjecting adhesion layer, which can be an aforementioned transition metal or metal nitride, preferably AlCr, AlTi, Cr, Ti, AlCrN, AlTiN, TiN or CrN.

20 Claims, 3 Drawing Sheets

U.S. PATENT DOCUMENTS

| | | | | |
|---|---|---|---|---|
| 6,716,540 | B2 * | 4/2004 | Kohara et al. | 428/408 |
| 6,827,976 | B2 * | 12/2004 | Derflinger et al. | 427/249.1 |
| 7,166,155 | B2 * | 1/2007 | Ishikawa | 428/699 |
| 7,226,670 | B2 * | 6/2007 | Derflinger et al. | 428/697 |
| 2002/0136895 | A1 | 9/2002 | Kohara et al. | |
| 2003/0035894 | A1 | 2/2003 | Derflinger et al. | |

FOREIGN PATENT DOCUMENTS

| | | | |
|---|---|---|---|
| JP | 10-025566 | * | 1/1998 |
| JP | 2002-160129 | * | 6/2002 |

OTHER PUBLICATIONS

Patent Abstracts of Japan, vol. 2002, No. 10, Oct. 10, 2002 & JP 2002 160129 A (TOYO Advanced Technologies Co Ltd: WAKNO SANGYO KK), Jun. 4, 2002 abstract.

Lugscheider E et al: "Investigations of mechanical and tribological properties of CrA1N+C thin coatings deposited on cutting tools" Surface and Coatings Technology, Elsevier, Amsterdam, NL, vol. 174-175, Sep. 13, 2002, pp. 681-686, XP 002282705. ISSN: 0257-8972. The whole document.

International Search Report dated Oct. 4, 2006.

* cited by examiner

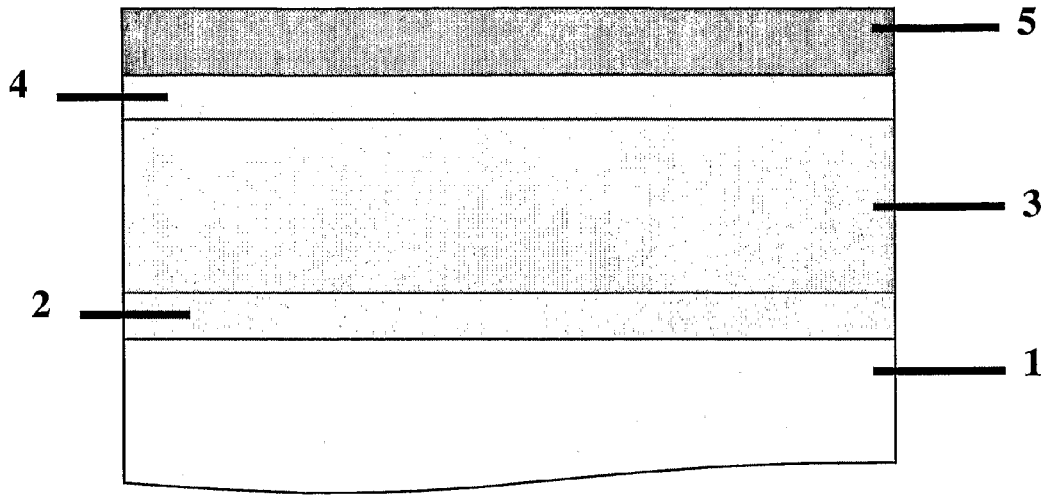
Fig. 1
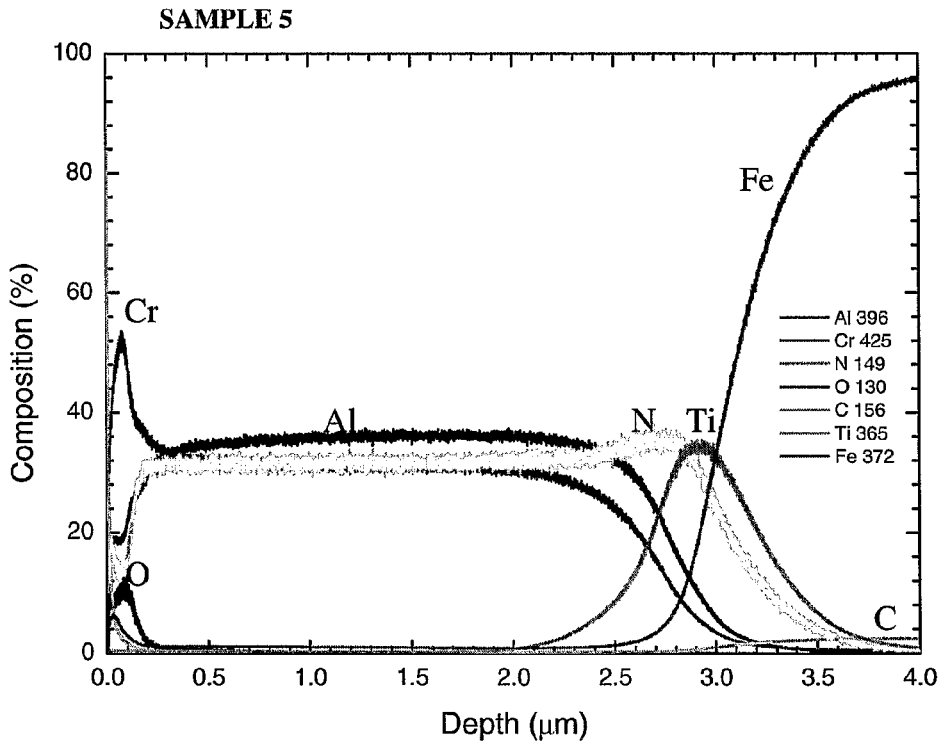
FIG.2: GDOES Depth Profile Spectrum of comparative sample 5 after annealing at 900°C

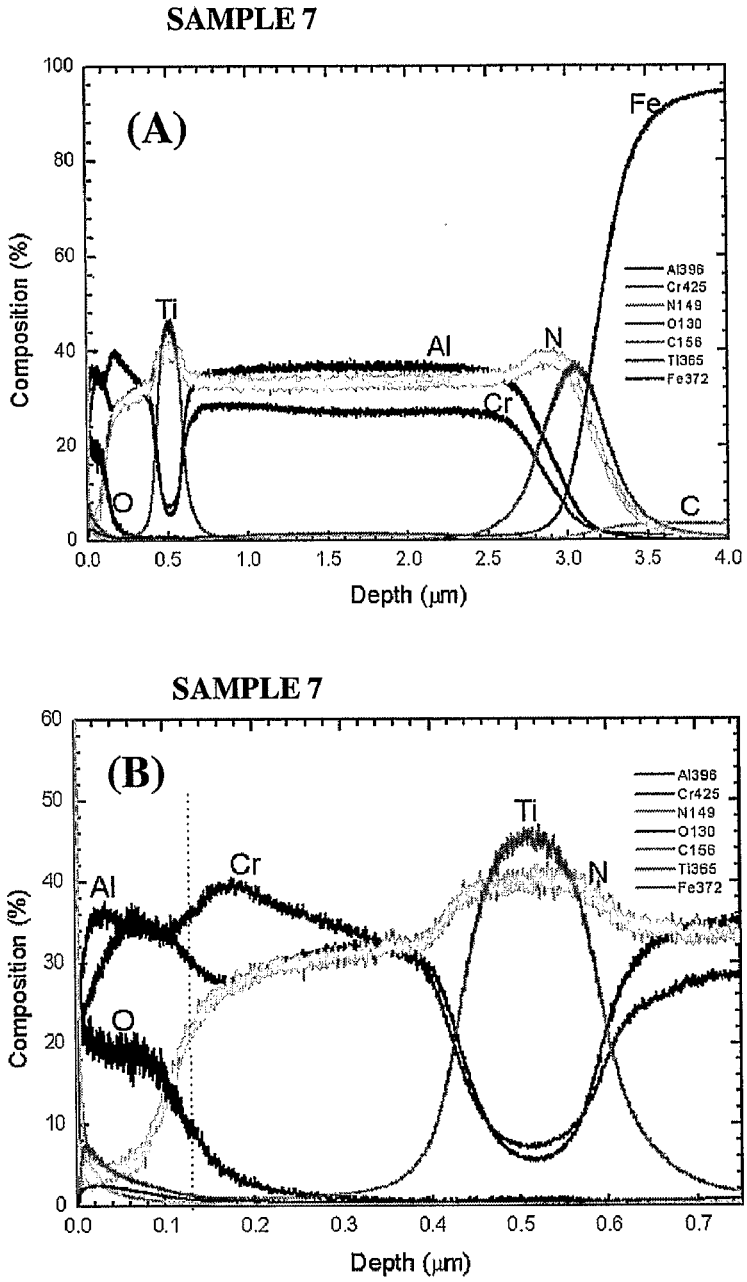
FIG.3: GDOES Depth Profile Spectrum of optimized coating after oxidation at 900°C

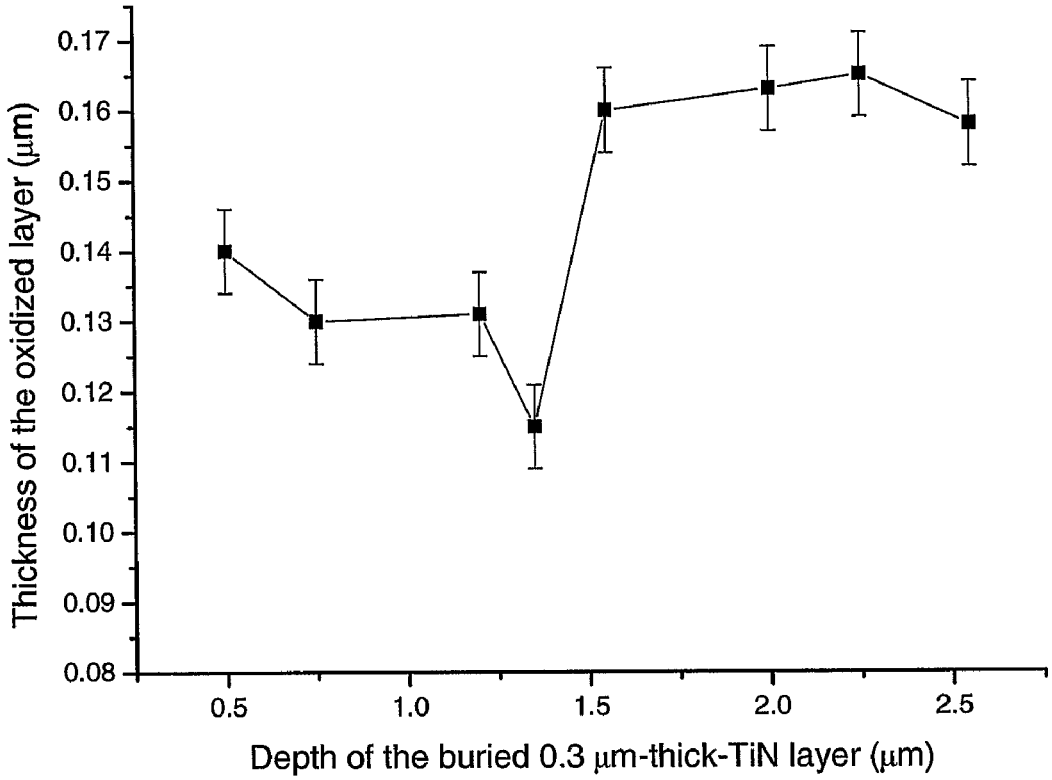
FIG.4: Oxidized layer thickness of triplex layers after annealing at 900°C.

HIGH WEAR RESISTANT TRIPLEX COATING FOR CUTTING TOOLS

CROSS REFERENCE TO RELATED APPLICATION:

This application claims the benefit to U.S. Provisional Patent Application No. 60/651,916 filed on Feb. 10, 2005. This application claims the benefit of International Application No. PCT/CH2006/000076, which was published in English on Aug. 17, 2006.

FIELD OF THE INVENTION

A hard coating with extremely high oxidation resistance for protecting a cutting tool that requires wear-protection. A respectively coated tool, especially a high speed steel, a cemented carbide or a cubic boron nitride (CBN) coated cutting tools such as end mills, drill bits, cutting inserts, gear cutters and hobs. Furtheron coated wear resistant machine parts, in particular mechanical components such as pumps, gears, piston rings, fuel injectors, etc. Metal forming coated tools that require wear protection such as dies, punches and molds.

RELATED ART

JP 10-025566 refers to hard anodic AlCr-based coatings with a very high oxidation resistance in comparison to TiN, TiCN and TiAlN coatings reducing the rate of abrasive and oxidation wear on cutting tools. In JP 2002-337007 and JP 2002-337005, AlCrSiN and CrSiBN layers provide not only excellent resistance to oxidation but an increased hardness providing a higher abrasion resistance. The Article "Properties of large-scale fabricated TiAlN- and CrN-based superlattice coatings by cathodic arc-unbalanced magnetron sputtering deposition." (in: Surface & Coatings Technology, v. 125, pp. 269-277 (2000)), Superlattice combinations based on TiAlN layers and fine layers of a transition metal nitride (VN and CrN) exhibit a low sliding wear and abrasive wear coefficient. In "Investigations of mechanical and tribological properties of CrAlN+C thin coatings deposited on cutting tools" (in: Surface & Coatings Technology, v. 174-175, pp. 681-686 (2003)) the authors report an improvement in the mechanical properties (such as hardness and increased Young's modulus) and frictional characteristics by combining CrAlN coating with a hard carbon surface. It is claimed that such combinations could be successful in drilling and milling applications. In "Towards an improvement of TiAlN hard coatings using metal interlayers" (Mat. Res. Soc. Symp. Proc. V. 750 (2003)), the authors refer to multilayer TiAlN combined with ductile interlayers of Al, Ti, Cu and Ag. Although the multilayers exhibited an improved adhesion to the substrate the hardness was significantly decreased with the addition of the ductile layers.

BACKGROUND OF THE INVENTION

Low wear resistance of TiCN, TiAlN, AlTiN, and similar hard coatings especially in high speed cutting applications where high temperatures are involved, hard to machine materials applications (for example, machining of tool steels, austenitic stainless steel, aluminum and titanium alloys). Despite the beneficial effects of known CrAlN and CrAlSiN coatings in high temperature applications, alternatives should be found which might give an even better performance for certain applications with tools, especially with cutting, forming tools and components, that can provide a larger productivity and further decrease in wear.

The cutting performance of CrAl-based layers can be further improved by the use of a triplex coating configuration which can lead to the formation of desired alumina based surface layers during machining. This new coating configuration for coatings increases the service life of tools and increases the machinability of workpiece materials as well as their productivity. The triplex AlCrN-based coatings presented in this invention were obtained using an industrial Balzers rapid coating system (RCS) machine. This machine contains a low voltage arc discharge arrangement that allows for rapid heating and etching of the substrates which promotes high adhesion strengths. The apparatus is also equipped with six deposition sources which can be chosen from sputtering, cathodic arc and nano-dispersed arc jet sources. During the deposition, a negative bias voltage can be applied to the substrate tools or components by using a fixed or a pulsed bias power supply. The entire description and drawings of the RCS equipment can be found under U.S. Ser. No. 2002/0053322.

SUMMARY OF THE INVENTION

The invention refers to innovative coating triplex system and corresponding coated tools and components, having a surface where at least parts of said surface are coated with a wear resistant hard coating comprising an outer surface layer followed by a second buried layer being arranged between the surface layer and a main layer which is deposited on the workpiece either directly or via an interjecting adhesion layer.

The surface layer comprises AlCrZ, where Z stands for N, C, B, CN, BN, CBN, NO, CO, BO, CNO, BNO, or CBNO having a thickness ($t_i$) of 0.2 μm<$t_i$<2 μm.

The buried comprises any one of the following materials or their combinations: a metal nitride, carbide or carbonitride (e.g. Ti(C)N, Ta(C)N, Nb(C)N, W(C)N, WTa(C)N, WTi(C)N, etc.), a metal silicon nitride, carbide, or carbonitride (e.g. TiSi(C)N, TaSi(C)N, WSi(C)N, TiWSi(C)N, etc.), wherein the metal is at least one transition metal of the IVB, VB or VIB group or a multilayer of the materials or a material or a combination or a multilayer of the materials comprising at least one metal or carbon, preferably a diamond like carbon layer, the buried layer having a thickness ($t_2$) of 0.1 μm<$t_2$<1.5 μm.

The main layer comprises a nitride, carbide or carbonitride or a multilayer of nitride, carbide or carbonitride material having a thermal conductivity ($Tc^M$) of less or equal than 70% of a thermal conductivity ($Tc^B$) of the buried layer. The main layer preferably comprises at least one transition metal from the IVB, VB or VIB groups, at least one element from Al, Si or B and at least one from 0, C, or N. The layer has a thickness ($t_3$) of 1 μm<$t_3$<10 μm. The main layer can be deposited on the workpiece either directly or via an interjecting adhesion layer, which can be an aforementioned transition metal or metal nitride, preferably AlCr, AlTi, Cr, Ti, AlCrN, AlTiN, TiN or CrN.

SHORT DESCRIPTION OF THE DRAWINGS

FIG. 1. Sketch of the Invention

FIG. 2. GDOES Depth Profile Spectrum of comparative example after annealing at 900° C.

FIG. 3. GDOES Depth Profile Spectrum of optimized coating after annealing at 900° C.

FIG. 4. Oxidized layer thickness of triplex layers after annealing at 900° C.

DETAILED DESCRIPTION OF THE INVENTION

In the experiments relating to this invention, two of the six deposition sources were used to include a TiSiN or a TiN buried layer (around 0.3 μm thick), while the remaining four sources were utilized to deposit the first and third AlCrN layer using a sintered aluminum-chromium target (70Al:30Cr) and the ion plating deposition process.

Nitride, carbide and carbonitride coatings based on the Al—Cr system can provide excellent protection against oxidation, this is due in large to the high corrosion resistance of chromium which combined with aluminum can form thin protective aluminum oxide thin surface layers that form a strong protecting layer against oxidation and diffusion of oxygen into the coating. In comparison to the nitrides, carbides and carbonitrides based on the Ti-Al system, AlCrX (X=N, C, CN) type coatings cannot form porous rutile-type titanium oxide layers instead both chromium and aluminum form stable oxides even at high temperatures. Although both alumina and chromia surface layers can provide an enhance protection to the coating and subsequently to the tool, alumina is the most desirable of the two as it can better work as a barrier against diffusion and have a lower coefficient of friction during machining providing an increased durability.

On the other hand, crystalline binary transition metal nitrides, carbides and carbonitrides have in general less desirable mechanical and physical properties than the metastable systems containing aluminum, as they provide less protection against oxidation and diffusion wear and they have a higher thermal conductivity. The breakthrough coating design proposed in this invention lies on the concept of a buried layer with high thermal conductance layer located near the surface which provides the necessary conditions for the formation of an alumina surface layer due to the diffusion blockage of other metallic elements form the main layer and which can increase heat and thermal conductivity in the coating/chip interface but maintaining the thermal protection to the tool. The supporting layer must be hard and stable at high temperatures to provide support to the forming oxide layers but with the possibility to raise the near surface temperatures to form adequate surface oxides.

FIG. 1 shows a substrate (1) which can be made of any known tool bulk material (e.g. high speed steel, tool steel, cemented carbides, CBN cermets, ceramics, etc. . . . ) that is coated with a principal coating layer (3) which has a lower thermal conductivity than the buried layer and good hardness (e.g. a carbide, carbonitride or nitride coatings containing at least a transition metal as well as at least one element from Al, Si or B). Between the principal coating layer (3) and the substrate (1) optionally a thin adhesion layer (2) can be arranged to better support the main layer (3) and to provide a gradual transition between the thermal expansion of the substrate (1) and the thermal expansion of the main layer (3). The adhesion layer could comprise pure metals (such as V, Ti, Nb, Cr, or Zr) or nitrides (such as CrN, TiN, VN, etc. . . . ). Near the surface a buried supporting layer (4) has a thermal capacity larger than the one of CrAlN which induces changes in the oxidation behavior of the outer surface layer (5) which is based on the Al—Cr—X—C—O—N system where X is a transition metal or a combination of transition metals. The oxidation of a non optimized coating design is shown in FIG. 2 for comparison reasons. After oxidation in an ambient atmosphere for three hours, the comparative sample #5 only produces surface oxide layers based on chromium, while the comparative sample #6 produces a thin oxide layer based on aluminum but toped with chromium oxides. On the other hand, a triplex coating composed with optimized thickness layers of AlCrN—TiN—AlCrN, under the same treatment conditions leads to the formation of AlOx and AlCrOx layers as it is shown in FIG. 3. The depth profile spectra obtained by glow discharge optical emission spectroscopy (GDOES) in FIGS. 2 and 3 indicate that chromium diffusion into the surface is initiated after the buried layer, which would reduce the concentration of chromium into the surface consequently increasing the Al/Cr ratio and forming AlOx and AlCrOx alternate layers. These thin surface layers can act as lubricious layers between tool and the chip due to the favored tribochemistry of their contact surfaces. The buried layer does not only reduce the diffusion of transition metal atoms to the surface but also prevents the flow of oxygen atoms to the interface which could eventually delaminate the protective layers. Oxidation test results of triplex AlCrN—TiN—AlCrN layers at different buried depths are shown in FIG. 4. The results indicate that TiN layers buried less than 1.5 micrometer away from the surface have indeed improved oxidation resistance properties.

Thermal conductivity and diffusion barrier properties of some common coating materials.

| Coating Material | Thermal Conductivity (W/cm*K) | Diffusion Barrier at High T (Quality) |
|---|---|---|
| TiN | 27 | ++ |
| MoN | 20 | + |
| CrN | 25 | + |
| WN | 20 | ++ |
| WTiN | 18 | +++ |
| WTaN | 19 | +++ |
| TiCrN | 25 | ++ |
| TiSiN | 18 | +++ |
| TaSiN | 19 | +++ |
| WSiN | 17 | +++ |
| TiCN | 14 | ++ |
| CrC | 11 | + |
| WC | 10 | + |
| CrAlN | 5 | + |
| TiAlN(75:25) | 5 | ++ |
| TiAlN(50:50) | 7 | ++ |

On the other hand, the buried layer would normally have a higher thermal conductivity than the outer and third (main) layers The table above provides an overview of diffusion barrier properties and thermal conductivity for common coating materials. The higher thermal conductivity of the buried layer with respect to the outer and main layer promotes an improve longitudinal heat flow towards the chip near the surface, while the transversal heat flow into the tool is thereby reduced due to the lower thermal conductivity of the third main coating layer. The result is a protective coating system for mechanical components and cutting tools with a reduced abrasive, diffusion and oxidational wear properties.

EXPERIMENTAL RESULTS

Example 1

| Milling of Tool Steel - roughing | |
|---|---|
| Cutting tool: | End Mill cemented carbide roughing<br>Diameter D = 10 mm, Number of teeth z = 4 |
| Work piece: | Tool Steel, X 40 CrMoV 5 1, DIN 1.2344 (36 HRC) |
| Cutting parameter: | Cutting speed $v_c$ = 120 m/min (S = 3820 1/min)<br>Feed rate fz = 0.090 mm/U (f = 1375 mm/min)<br>Radial depth of cut $a_e$ = 2.5 mm<br>Axial depth of cut $a_p$ = 5.5 mm |
| Cooling: | Emulsion 6% |
| Process: | down milling |
| Tool life criterion: | Width of flank wear land VB > 0.10 mm. |

| Experiment No. | Fisrt Layer (near substrate.) Material | Thickness (μm) | Second Layer Material | Thickness (μm) | Third Layer Material | Thickness (μm) | Wear Life (m) |
|---|---|---|---|---|---|---|---|
| 1[C] | TiCN | 3.6 | — | — | — | — | 35 |
| 2[C] | TiAlN | 3.7 | — | — | — | — | 55 |
| 3[C] | TiAlN/TiN | 4.0 | — | — | — | — | 57 |
| 4[C] | AlTiN | 3.6 | — | — | — | — | 63 |
| 5[C] | AlCrN | 3.3 | — | — | — | — | 67 |
| 6[C] | AlCrN | 1.5 | TiN | 0.3 | AlCrN | 1.6 | 65 |
| 7* | AlCrN | 2.7 | TiN | 0.3 | AlCrN | 0.3 | 77 |
| 8* | AlCrN | 2.5 | TiSiN | 0.2 | AlCrN | 0.5 | 80 |

*denotes inventive coatings.
[C]denotes comparative examples

Example 1 shows an increased tool lifetime of new optimized triplex coating in comparison to standard TiCN, TiAlN, AlCrN monolayers and TiAlN/TiN multilayers.

Example 2

| Milling of Hardened Steel | |
|---|---|
| Cutting tool: | Ball nose end mill cemented carbide<br>Diameter D = 10 mm, Number of teeth z = 2 |
| Work piece: | K340 (62HRC) C 1.1%, Si 0.9%, Mn 0.4%, Cr 8.3%, Mo 2.1%, Mo 2.1%, V 0.5%. |
| Cutting parameter: | Cutting speed $v_c$ = 0-120 m/min<br>Feed rate fz = 0.10 mm/U<br>Radial depth of cut $a_e$ = 0.2 mm<br>Axial depth of cut $a_p$ = 0.2 mm |
| Cooling: | Dry |
| Process: | Finishing |
| Tool life criterion: | Width of flank wear land VB > 0.30 mm. |

| Experiment No. | Fisrt Layer (near substrate.) Material | Thickness (μm) | Second Layer Material | Thickness (μm) | Third Layer Material | Thickness (μm) | Wear Life (m) |
|---|---|---|---|---|---|---|---|
| 1[C] | TiCN | 3.6 | — | — | — | — | 31 |
| 2[C] | TiAlN | 3.7 | — | — | — | — | 52 |
| 3[C] | TiAlN/TiN | 4.0 | — | — | — | — | 62 |
| 4[C] | AlTiN | 3.6 | — | — | — | — | 83 |
| 5[C] | AlCrN | 3.3 | — | — | — | — | 73 |
| 6[C] | AlCrN | 1.5 | TiN | 0.3 | AlCrN | 1.6 | 78 |
| 7* | AlCrN | 2.7 | TiN | 0.3 | AlCrN | 0.3 | 93 |
| 8* | AlCrN | 2.5 | TiSiN | 0.2 | AlCrN | 0.5 | 93 |

*denotes inventive coatings.
[C]denotes comparative examples

Example 2 shows a tool lifetime of 93 m for both new optimized triplex coatings. The closest state of the art layer AlTiN only had a lifetime of 83 m.

The invention claimed is:

1. Hard coating layer system comprising at least a main layer (3) on a surface of a substrate (1), a buried layer (4) and an outer surface layer (5), wherein the surface layer (5) comprises AlCrZ with Z standing for N, C, B, CN, BN, CBN, NO, CO, BO, CNO, BNO, or CBNO, the surface layer (5) having a thickness $t_1$ of 0.2 μm<$t_1$<2 μm;

the buried layer (4) comprises any one of the following materials or their combinations: a metal nitride, carbide or carbonitride, a metal silicon nitride, carbide, or carbonitride, the metal being at least one transition metal of the IVB, VB or VIB group or a multilayer of the materials or a material or a combination of a multilayer of the materials comprising at least one metal or carbon;

the main layer (3) comprises a nitride, carbide or carbonitride or a multilayer of nitride, carbide or carbonitride material, wherein the buried layer (4) is a diamond like carbon layer.

2. Hard coating layer system according to claim 1, wherein between the main layer (3) and the surface of the substrate (1) an adhesion layer (2) is arranged.

3. The Hard coating layer system according to claim 1, wherein the buried layer (4) has a thickness $t_2$ of 0.1 μm<$t_2$<1.5μm.

4. The Hard coating layer system according to claim 1, wherein the main layer (3) has a thickness $t_3$ of 1 μm<$t_3$<10μm.

5. Hard coating layer system according to claim 1, wherein the main layer (3) has a thermal conductivity $Tc^M$ of less or equal than 70% of a thermal conductivity $Tc^B$ of the buried layer (4).

6. Hard coating layer system according to claim 5, wherein the main layer comprises at least one transition metal from the IVB, VB or VIB groups, at least one element from Al, Si or B and at least one from O, C, or N.

7. Hard coating layer system according to claim 2, wherein the adhesion layer (2) comprises at least one transition metal from the IVB, VB or VIB groups or a metalnitride.

8. Hard coating layer system according to claim 7, wherein the adhesion layer (2). comprises V, Ti, Nb, Cr, Zr, AlCr, AlTi, AlCrN, AlTiN, TiN, VN or CrN.

9. Hard coating layer system according to claim 1, wherein the substrate (1) comprises high speed steel, tool steel, cemented carbides, CBN cermets or ceramics.

10. Hard Tool or component, having a surface (1) where at least parts of said surface are coated with a wear resistant hard coating according to claim 1.

11. Hard coating layer system comprising at least a main layer (3) on a surface of a substrate (1), a buried layer (4) and an outer surface layer (5), wherein the surface layer (5) comprises AlCrZ with Z standing for N, C, B, CN, BN, CBN, NO, CO, BO, CNO, BNO, or CBNO, the surface layer (5) having a thickness $t_1$ of $0.2\mu m<t_1<2\ \mu m$;

the buried layer (4) comprises one of Ti(C)N, Ta(C)N, Nb(C)N, W(C)N, WTa(C)N, WTi(C)N, or TiSi(C)N, TaSi(C)N, WSi(C)N, TiWSi(C)N;

the main layer (3) comprises a, nitride, carbide or carbonitride or a multilayer of nitride, carbide or carbonitride material, wherein the buried layer (4) is a diamond like carbon layer.

12. Hard coating layer system according to claim 11, wherein between the main layer (3) and the surface of the substrate (1) an adhesion layer (2) is arranged.

13. The Hard coating layer system according to claim 11, wherein the buried layer (4) has a thickness $t_2$ of $0.1\ \mu m<t_2<1.5\ \mu m$.

14. The Hard coating layer system according to claim 11, wherein the main layer (3) has a thickness $t_3$ of $1\ \mu m<t_3<10\ \mu m$.

15. Hard coating layer system according to claim 11, wherein the main layer (3) has a thermal conductivity $Tc^M$ of less or equal than 70% of a thermal conductivity $Tc^B$ of the buried layer (4).

16. Hard coating layer system according to claim 11, wherein the main layer comprises at least one transition metal from the IVB, VB or VIB groups, at least one element from Al, Si or B and at least one from O, C, or N.

17. Hard coating layer system according to claim 12, wherein the adhesion layer (2) comprises at least one transition metal from the IVB, VB or VIB groups or a metalnitride.

18. Hard coating layer system according to claim 17, wherein the adhesion layer (2) comprises V, Ti, Nb, Cr, Zr, AlCr, AlTi, AlCrN, AlTiN, TiN, VN or CrN.

19. Hard coating layer system according to claim 11, wherein the substrate (1) comprises high speed steel, tool steel, cemented carbides, CBN cermets or ceramics.

20. Hard Tool or component, having a surface (1) where at least parts of said surface are coated with a wear resistant hard coating according to claim 11.

* * * * *

UNITED STATES PATENT AND TRADEMARK OFFICE

CERTIFICATE OF CORRECTION

PATENT NO. : 7,879,443 B2
APPLICATION NO. : 11/815978
DATED : February 1, 2011
INVENTOR(S) : Endrino It is certified that error appears in the above-identified patent and that said Letters Patent is hereby corrected as shown below:

On the Title page, Item (73) Assignee, please replace "OC Oerlikon Trading, AG, Truebbach, Truebbach (CH)" with -- Oerlikon Trading, AG, Truebbach, Truebbach (CH) --

Signed and Sealed this
Seventh Day of June, 2011

David J. Kappos

David J. Kappos
*Director of the United States Patent and Trademark Office*